United States Patent [19]

Levchenko et al.

[11] Patent Number: 4,771,661

[45] Date of Patent: Sep. 20, 1988

[54] VIBRATORY PIPE WRENCH

[75] Inventors: Georgy T. Levchenko; Alexandr N. Radzikovsky, both of Kiev, U.S.S.R.

[73] Assignee: Kievsky Politenkhnichesky Institut, Kiev, U.S.S.R.

[21] Appl. No.: 47,922

[22] PCT Filed: Sep. 25, 1985

[86] PCT No.: PCT/SU85/00080

§ 371 Date: Mar. 6, 1987

§ 102(e) Date: Mar. 6, 1987

[87] PCT Pub. No.: WO87/00477

PCT Pub. Date: Jan. 29, 1987

[51] Int. Cl.[4] ..... B25B 13/50

[52] U.S. Cl. ..... 81/57.33; 81/463

[58] Field of Search ..... 81/463, 464, 54, 57.33, 81/57.39

[56] References Cited

FOREIGN PATENT DOCUMENTS 0636074 12/1978 U.S.S.R. ..... 81/54

1088923 4/1984 U.S.S.R. ..... 81/54

*Primary Examiner*—Debra Meislin

*Attorney, Agent, or Firm*—Burgess, Ryan and Wayne

[57] ABSTRACT

A vibratory pipe wrench includes a hollow handle provided with a fit-on movable jaw and a vibrator, the vibrator being electrically connected to an alternating voltage generator and having a gripping jaw adapted to interact with a pipe being handled, in conjunction with the fit-on movable jaw, the vibrator being movable along the longitudinal axis of the handle, the handle having an additional gripping jaw adapted to interact with the pipe when the vibrator is moved deeper into the hollow interior of the handle, the wrench further including a feedback circuit which electrically interconnects the vibrator and the generator.

3 Claims, 1 Drawing Sheet

VIBRATORY PIPE WRENCH

TECHNICAL FIELD

The present invention relates generally to mechanical engineering and more specifically, to a vibratory pipe wrench.

BACKGROUND ART

Known in the present state of the art is a vibratory pipe wrench (cf., e.g., USSR Inventor's Certificate No. 647,103, Int. Cl. B25B 13/50, priority of Feb. 14, 1977, published Feb. 15, 1979 in the "Bulletin of discoveries, inventions, industrial designs and trade marks", No. 6, p. 39 (in Russian), which comprises a hollow handle with a vibrator and a fit-on movable jaw. The vibrator is located in the handle interior and has a gripping jaw, which is essentially a tip of a wear-resistant material designed to be in contact with the pipe being turned up.

The vibrator is made of a piezoelectric material and is electrically connected to a generator to establish elastic vibrations therein, which are imparted to the pipe in the form of impacts directed at an acute angle to the pipe surface. The vibrator rests upon supports made from a low-elastic material, such as rubber, so as to prevent vibrator oscillations from penetrating into the handle.

The fit-on movable jaw is articulated to the handle and is provided with two rollers which grip the pipe and serve also as stops.

However, the aforediscussed vibratory pipe wrench features but low operating reliability due to a possible breakage of the vibrator (made from such a brittle material as piezoceramics) when the wrench is overstrained by the operator.

Moreover, the torque developed by the vibrator is oftentimes inadequate to finally tighten the thread joint. This is because the torque is proportionate to the amplitude of the vibrator oscillations, while said amplitude is restricted to too low a value.

Furthermore, when the vibratory pipe wrench in question operates on an idle run, i.e., the vibrator gripping jaw does not contact the pipe being handled and relays no impact energy to the pipe, the amplitude of the vibrator oscillations and hence the varying mechanical stresses therein will be much higher than those in the course of operation under load when the vibrator gripping jaw contacts the pipe being handled and part of acoustic energy is imparted to the pipe. Since the maximum mechanical stresses in the vibrator developed during the idle-run operation should not exceed the permissible stress value of the material the vibrator is made from, the varying stresses and hence the torque developed during operation under load, that is, during the pipe rotation, will be much lower than those maximum attainable with a given construction.

In addition, in case of considerable amplitudes of the vibrator oscillations the latter grows overheated due to electrical and mechanical losses therein, which places further restrictions upon the torque magnitude developed by the known vibratory pipe tongs.

And last but not least, the vibrator resonant frequency is liable to vary in the course of operation depending upon the degree of wear on the gripping jaw thereof and upon the altering force of its pressure against the pipe. This, in turn, necessitates permanent readjustment of the generator frequency which complicates the operation of the known vibratory pipe wrench.

DISCLOSURE OF THE INVENTION

The present invention has for its principal object the provision of a vibratory pipe wrench whose construction would make it more reliable in operation with a high magnitude of the torque imparted to the pipe, and also a simplified construction of such a wrench.

Said object is accomplished due to the fact that in a vibratory pipe wrench, comprising a hollow handle provided with a fit-on movable jaw and a vibrator accommodated in the handle hollow interior, electrically connected to an alternating voltage generator and having a gripping jaw adapted for interaction with a pipe along with the fit-on movable jaw, according to the invention, the vibrator is movable along the longitudinal axis of the handle and an additional gripping jaw is provided on the handle adapted to interact with the pipe when the vibrator gripping jaw is moved deeper into the hollow interior of the pipe, and a feedback circuit is provided, which connects electrically the vibrator to the alternating voltage generator.

Thanks to the fact that the vibrator is movable along the longitudinal axis of the handle and an additional gripping jaw is provided on the handle, the vibrator comes out of strong gripping contact with the pipe in response to an increase in the pressure force applied, thus letting the additional gripping jaw lock the pipe in place and transmit considerable torque thereto, which is developed by the operator's effort when drawing the threaded joint finally tight. In this case the vibrator is fully accomodated in the handle interior space, which protects the vibrator from possible destruction, thus enhancing the operating reliability of the vibratory pipe wrench as a whole.

Provision of a feedback circuit which connects electrically the vibrator to the alternating-voltage generator, enables automatic in-service readjustment of the alternating-voltage generator frequency, so as to maintain it equal to the vibrator resonant frequency. This in turn provides for the maximum vibrator oscillation amplitude and hence the maximum torque applied, as well as simplifies the operation of the vibratory pipe wrench.

It is recommended that movement of the vibrator along the longitudinal axis of the handle be spring actuated.

Provision of such an actuating spring enables one to maintain the force of the vibrator pressing against the pipe being handled within the permissible limits irrespective of the effort applied by the operator.

It is expedient that the alternating voltage generator should comprise series-connected a current regulator, a master oscillator, a modulator and a power amplifier, the output of the latter being connected to the vibrator, while the feedback circuit should be electrically connected to the input of the current regulator and to the input of the master oscillator.

Provision of a feedback circuit electrically connecting the vibrator to the alternating voltage generator makes it possible to use the current regulator which enables one to establish varying mechanical stresses in the vibrator, equal under any operating conditions of the vibratory pipe wrench and approximating the maximum allowable ones. Consequently, the vibratory pipe wrench, when under load (that is, with the pipe rotating) will develop the maximum torque admissable by the given construction.

However, this will be accompanied by increased electrical and acoustical losses in the vibrator, whereby its heating will increase accordingly. It is therefore desirable that use should be made, concurrently with the current regulatr, of a modulator capable of shaping a train of pulses following one another, from a continuous alternating voltage applied.

It should be noted that whenever a considerable amount of power is delivered in the pulses arriving at the generator enabling high torque to be developed, an average amount of power delivered for a period of pulse generating will be rather low and thus will not be causative of bad vibrator heating.

Thus, the vibratory pipe wrench according to the invention features rather high reliability with a considerable torque imparted to the pipe.

Besides, the proposed construction of the vibratory pipe wrench renders its operation much simpler, increases labour productivity and improves the quality of installation work.

Given below is a description of a specific exemplary embodiment of the present invention with reference to the accompanying drawings.

BEST MODE OF CARRYING OUT THE INVENTION

Figure 1:
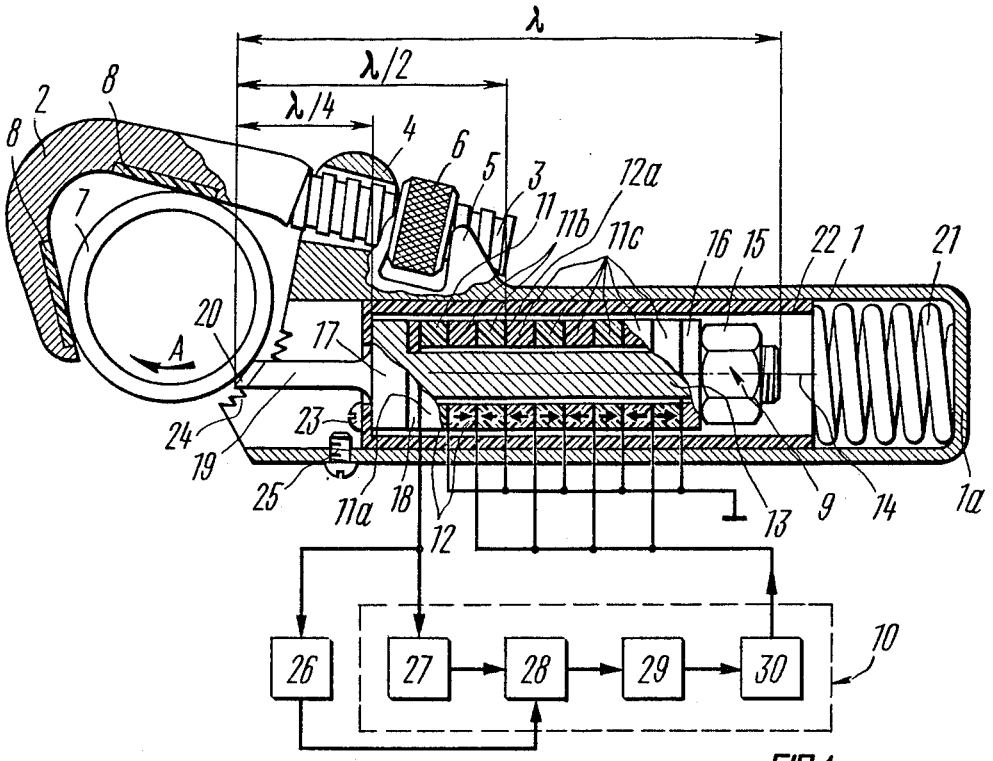
FIG. 1 is a diagrammatic longitudinal-section view of a vibratory pipe wrench, according to the invention.

A vibratory pipe wrench according to the present invention, comprises a hollow cylindrical handle 1 (FIG. 1) carrying a fit-on movable jaw 2 which has a threaded end 3 passing through an opening (not designated) in a boss 4 formed at the end of the handle 1 facing the fit-on clip 2. A boss 5 with a seat (not shown) is spaced somewhat apart from the boss 4 on the handle 1, said seat accepting the threaded end 3 of the fit-on movable jaw 2.

Interposed between the bosses 4 and 5 is a nut 6 of a known construction, said nut being screwed onto the threaded end 3 and adapted for adjusting the fit-on movable jaw 2 for position with respect to the handle 1. The angle (not shown) of curvature of the fit-on movable jaw 2 equals approximately 60 degrees, though it may differ from that magnitude in some other cases.

The fit-on movable jaw 2 has straps 8 situated at the places in contact with a pipe 7 to be gripped, said straps being made of a low friction coefficient material and sunk flush into the fit-on movable jaw 2. According to an alternative embodiment of the vibratory pipe wrench the straps 8 may be substituted by rollers installed on the inner surface of the movable jaw 2 and intended to keep the pipe 7 in position.

A vibrator 9 is accommodated in the interior of the handle 1, said vibrator being electrically connected to an alternating voltage generator 10 and intended for producing acoustical vibrations and imparting these to the pipe 7.

The vibrator 9 is made up of a stack of rings 11 made of a piezoelectric material, and of washers 12 made of a current-conducting material and arranged alternately between the rings 11. Both the piezoelectric rings 11 and the current-conducting washers 12 are fitted over a bolt 13 accommodated in the vibrator 9 along longitudinal axis 14 thereof which is also the longitudinal axis of the handle.

The vibrator longitudinal axis 14 intersects the surface of the pipe 7 at an angle approximately equal to 45 degrees (not shown), though said angle may have another magnitude in some other case. A nut 15 of a known construction is screwed onto the threaded end (not shown) of the bolt 13, and a metallic washer 16 is put thereon. The bolt 13 has a head 17, a washer 18 made of a dielectric material being interposed between the head 17 and the stack of the rings 11. Both the bolt 13 and the nut 15 are adapted for set-up compression of the stack 11 of the piezoelectric rings 11*a*, 11*b*, 11*c*. A rod 19 is locked in place on the head 17 of the bolt 13, said rod being aligned with the axis 14 and serving as a concentrator of the acoustical vibrations transmitted from the vibrator to the pipe 7.

In some other embodiments of the vibratory pipe wrench the rod 19 may feature its cross-sectional area variable as for length.

The vacant end of the rod 19 carries a gripping jaw 20 shaped as a plate made of a wear-resistant material and inclined to an angle of approximately 45 degrees (not shown) to the axis 14 of the vibrator 9 and tangentially to the surface of the pipe 7.

The gripping jaw 20 is adapted for interaction with the pipe 7 along with the fit-on movable jaw 2.

The vibrator 9 is movable along the longitudinal axis 14 by virtue of the tension of a coil spring 21 which is accommodated in the interior space of the handle 1 at its end opposite to the bosses 4 and 5. With one of its ends the spring 21 rests against the bottom 1*a* of the handle 1, and with the other end, against a sleeve 22 situated inside the hollow space of the handle 1 and adjoining its inner side wall.

The bottom (not designated) of the sleeve 22 is secured to the head 17 of the bolt 13 by screws 23. An opening (not designated) is provided in the bottom of the sleeve 22 for the rod 19 to pass through, while the remaining portion of the vibrator 9 is accommodated inside the sleeve 22.

An additional gripping jaw 24 is provided on the handle 1 adapted to interact with the pipe 7 when the gripping jaw 20 of the vibrator 9 is brought out of engagement with the pipe 7.

The additional gripping jaw 24 is essentially a toothed rim provided on the end portion of the handle 1 facing the pipe 7 and extended tangentially to the surface of the pipe 7. A multitude of similar teeth (not designated) on the additional gripping jaw 24 are inclined towards the direction of rotation of the pipe 7 as indicated with an arrow A.

A screw 25 is provided on the side wall of the handle 1 close to its end carrying the additional gripping jaw 24, said screw serving as an arrester that prevents the sleeve 22 with the vibrator 9 against being extended from the interior of the handle 1 under the action of the spring 21 in the case where no pipe 7 is gripped by the movable jaw 2.

The handle 1 may be enclosed in a rubber sheath or coating (not shown) adjacent to the handle outer surface on the area in contact with the operator's hand.

A feedback circuit 26 is provided, which interconnects electrically the vibrator 9, more specifically, the piezoelectric ring 11*c*, and the alternating voltage generator 10.

The alternating voltage generator 10 comprises series-connected a current regulator 27, a master oscillator 28, a modulator 29, and a power amplifier 30 whose output (not designated) is connected to the piezoelectric rings 11*b*, 11*c* of the vibrator 9. The feedback circuit 26 is also electrically connected to the input (not designated) of the current regulator 27 and to one of the inputs (not designated) of the master oscillator 28.

A total length of the vibrator 9 equals the length λ (in meters) of a wave of acoustical vibrations, though in some other embodiments of the vibratory pipe wrench a total length of the vibrator 9 is multiple of half the wavelength λ. The length of the rod 19 equals one-fourth the wavelength λ. The acoustic wavelength is calculated by the heretofore-known formulas and depends on the propagation velocity of acoustic vibrations, which is different in various materials, and on the vibration frequency.

The direction (indicated with unnumbered arrowheads) of the preliminary polarization of the piezoelectric rings 11*b* during either of the half-waves of the alternating voltage delivered by the generator 10, coincides with the direction of an electric field induced in said rings, while the direction of such polarization in the rings 11*c* is opposite to the direction of the electric field induced therein. The distance from the current-conducting washer 12*a* sandwiched between the piezoelectric rings 11*b* and 11*c*, to either of the ends of the vibrator 9 equals half the wavelength λ.

The vibratory pipe wrench embodied according to the present invention operates as follows.

The vibratory pipe wrench is put over the pipe 7 with its fit-on movable jaw 2, the latter is adjusted for position using the nut 6 so that the pipe 7 should be brought in contact with the movable jaw 2 and the gripping jaw 20 of the vibrator 9. In other words, the gripping jaw 20 is forced against the surface of the pipe 7 and the sleeve 22 with the vibrator 9 is somewhat displaced from its initial position, thus compressing the spring 21 to some extent.

An alternating voltage produced by the generator 10 and applied to the piezoelectric rings 11*b*, 11*c* induces therein acoustic compression-tension vibrations directed along the axis 14 and imparted to the vibrator 9.

As a result, the gripping jaw 20 of the vibrator 9 delivers impacts against the surface of the pipe 7 directed at an angle thereto and making the pipe rotate in a direction of the arrow A. The vibratory pipe wrench itself remains in this case immovable.

Once the pipe 7 has been screwed up the torque is increased by applying a higher effort to the handle 1. As a result, the sleeve 22 with the vibrator 9 is urged by the pipe 7 to move along the axis 14 towards the bottom 1*a* of the handle 1, thus compressing the spring 21 even further.

Then the pipe 7 gets in engagement with the additional gripping jaw 24, whereupon the pipe 7 is tightened finally with an increased torque by turning the vibratory pipe wrench along with the pipe 7 through an inconsiderable angle.

The vibrator 9 at a position where it is held to the bottom of the sleeve 22 is spaced a distance equal to one-fourth the wavelength λ from the end of the rod 19 so that the amount of vibrating displacement of the vibrator 9 at such a position equals zero, which precludes losses of acoustical energy through the bottom of the sleeve 22.

Since the length of the vibrator 9 equals to the acoustic wavelength λ, one of the vibrator halves (not designated) gets stretched, in succession, along the axis 14, whereas the other half of the vibrator is contracted along the same axis, and vice versa. That is why the piezoelectric rings 11*b* and 11*c* located in the different halves of the vibrator 9, feature oppositely directed preliminary polarization with respect to the electric field applied, whereby a possibility is provided of establishing mechanical stresses therein under the effect of alternating voltage applied, said stresses being synchronous with the compression and tension waves in each portion of the vibrator 9.

Acoustic waves in the vibrator 9 set up an alternating voltage on the piezoelectric ring 11*a*, which serves as a feedback transmitter, said voltage being proportional to an alternating mechanical stress in the vibrator 9. The aforementioned alternating voltage is impressed upon the input of the feedback circuit 26, which is in fact a limiting amplifier that activates the master oscillator 28 at a frequency of the vibrator 9.

Thus, there is carried out an automatic adjustment of the frequency of the alternating voltage generator 10 for the resonant frequency of mechanical vibrations produced by the vibrator 9. The continuous alternating square-wave voltage shaped by the master oscillator 28, is applied to the input (not designated) of the modulator 29, which establishes a continuous train of narrow pulses of modulated oscillations.

Figure 2:
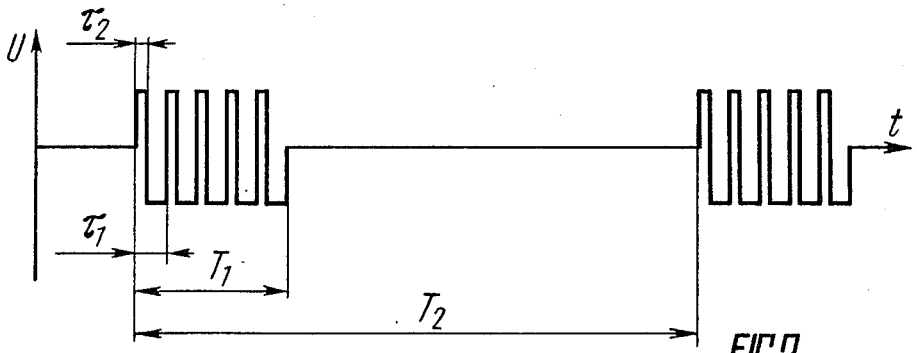
FIG. 2 represents a time-referenced diagram of voltage at the power amplifier input.

FIG. 2 is a graphic representation of a voltage U at the output (not designated) of the modulator 29 versus a running time t (seconds), the pulse width being denoted as $T_1$, the pulse interval, as $T_2$.

The voltage from the output of the modulator 29 is delivered to the power amplifier 30 whose output stages operate in a switching mode which eliminates heat losses therein nearly completely. The output stages of the power amplifier 30 are provided with a capacitance-inductance filter which derives the first harmonic from the square-wave alternating voltage, said harmonic being then delivered to the piezoelectric rings 11*b*, 11*c* of the vibrator 9.

A period $\tau_1$ (in seconds) (FIG. 2) of oscillations within a voltage pulse equals the period of oscillations shaped by the master oscillator 28 and coinciding with the period of resonant vibrations produced by the vibrator 9.

The alternating voltage proportional to the alternating mechanical vibrations in the vibrator 9, is delivered from the feedback circuit 26 to the input of the current regulator 27, which shapes a voltage that effects control over the master oscillator 28 by varying the duration $\tau_2$ of one of the half-waves of the voltage shaped by it.

In this case the period $\tau_1$ remains invariable. Thence, with the constant amplitude of the alternating voltage shaped by the master oscillator 28, it is the amplitude of the first harmonic of said voltage that is to vary.

The current regulator 27 is so connected that when, e.g., the alternating voltage generated on the piezoelectric ring 11*a* is increased, the current regulator 27 reduces the amplitude of the first harmonic of the alternating voltage at the output of the master oscillator 28 and hence at the output of the alternating voltage generator. Thus, while automatically maintaining the alternating mechanical stresses in the vibrator 9 at a constant value, the current regulator 27 provides for the maximum torque magnitude admitted by the given construction of the vibratory pipe wrench under any operating conditions of the latter.

The modulator 27 which shapes pulses of low width $T_1$ and large pulse interval $T_2$, makes it possible to considerably increase the amplitude of vibrations generated by the vibrator 9 at the instant when a pulse is applied thereto without a danger of its overheating, which in turn enables one to increase the torque developed by the present vibratory pipe wrench.

Experimental specimens of the vibratory pipe wrench made according to the present invention, have passed successfully the practical tests, the results of which demonstrate reliable operation of the wrench within a wide range of operating conditions.

Practical application of the disclosed vibratory pipe wrench makes it possible to efficiently utilize the inner space of a plant, wherein pipes are being laid, since threaded pipe connection can be effected at a single setting of the vibratory pipe wrench thereon, which adds also to labour productivity and to the standard of installation work.

INDUSTRIAL APPLICABILITY

The present invention can find most utility when applied for making and breaking pipe threaded joints.

The vibratory pipe wrench made according to the present invention is also applicable for assembly operations in shipbuilding, aircraft industry, power engineering, in particular, nuclear power, and in some other industries, as well as for erection work in outer space. It is especially reasonable to use the present invention under conditions of cramped quarters.

In addition, the vibratory pipe wrench will find application in robot-assisted assembly systems.

The present vibratory pipe wrench can also be used for assembly of not only pipe joints but also any other threaded joints, for which purpose the wrench can be equipped with a set of change grips for holding diverse items being handled.

We claim:

1. A vibratory pipe wrench, comprising:

a hollow handle having a hollow interior and a longitudinal axis;

a fit-on movable jaw movably connected to said handle and serving to clamp a pipe;

a vibrator having a gripping jaw for interaction with the pipe in conjunction with said movable jaw, said vibrator accommodated in the hollow interior of said handle and capable of being moved along said longitudinal axis;

an additional gripping jaw arranged on said handle and intended to interact with the pipe when said vibrator is moved deeper into the hollow interior of said handle;

an alternating voltage generator electrically connected to said vibrator; and a feedback circuit electrically connecting said vibrator and said alternating voltage generator.

2. A vibratory pipe wrench as claimed in claim 1, further including a spring in the hollow interior of said handle for moving said vibrator along said longitudinal axis in the hollow interior of said handle.

3. A vibratory pipe wrench as claimed in claim 1, wherein said alternating voltage generator comprises a current regulator, a master oxcillator, a modulator and a power amplifier, all connected in series, the output of said power amplifier being connected to said vibrator, and said feedback circuit being electrically connected to the input of said current regulator and to the input of said master oscillator.

* * * * *